US006014959A

United States Patent [19]

Ma

[11] Patent Number: 6,014,959

[45] Date of Patent: Jan. 18, 2000

[54] ENGINE WITH EGR MANAGEMENT SYSTEM

[75] Inventor: Thomas Tsoi-Hei Ma, Ferrers, United Kingdom

[73] Assignee: Ford Global Technologies, Inc., Dearborn, Mich.

[21] Appl. No.: 09/180,945

[22] PCT Filed: May 14, 1997

[86] PCT No.: PCT/GB97/01320

§ 371 Date: Dec. 11, 1998

§ 102(e) Date: Dec. 11, 1998

[87] PCT Pub. No.: WO97/44579

PCT Pub. Date: Nov. 27, 1997

[30] Foreign Application Priority Data

May 18, 1996 [GB] United Kingdom ..... 9610493

[51] Int. Cl.[7] ..... F02M 25/07; F02D 21/08

[52] U.S. Cl. ..... 123/568.19

[58] Field of Search ..... 123/568.19, 568.18

[56] References Cited

U.S. PATENT DOCUMENTS

| | | | |
|---|---|---|---|
| 3,983,854 | 10/1976 | August | 123/568.19 |
| 4,027,636 | 6/1977 | Yamamoto et al. | 123/568.19 |
| 4,149,503 | 4/1979 | Ozaki et al. | 123/568.19 |
| 4,224,912 | 9/1980 | Tanaka | 123/568.19 |
| 4,233,946 | 11/1980 | Yurioka et al. | 123/568.19 |
| 4,282,846 | 8/1981 | Minoura | 123/568.19 |
| 4,366,799 | 1/1983 | Suda | 123/568.19 |
| 4,924,840 | 5/1990 | Wade | 123/568.19 |

*Primary Examiner*—Tony M. Argenbright
*Assistant Examiner*—Arnold Castro
*Attorney, Agent, or Firm*—Jerome R. Drouillard

[57] ABSTRACT

A spark ignition internal combustion engine is provided including an intake manifold. A main throttle regulates the intake of ambient air into the intake manifold. An EGR pipe is connected between a point in the intake manifold downstream of the main throttle and a point in the exhaust system located downstream of the main restriction to exhaust gas flow. The exhaust gas pressure at the latter point is substantially constant during engine operation. An EGR throttle is rigidly connected for movement with the main throttle. The EGR throttle has a similar geometry to the main throttle such that the flow cross sections of the main throttle and the EGR throttle are in a fixed predetermined ratio to one another for all positions of the main throttle.

20 Claims, 2 Drawing Sheets

ENGINE WITH EGR MANAGEMENT SYSTEM

The present invention relates to an engine having a management system for controlling the dilution of the mixture supplied to the combustion chambers with recirculated exhaust gases and/or additional air.

BACKGROUND OF THE INVENTION

It is desirable from the points of view of reducing $NO_x$ emissions and improving engine fuel consumption to dilute the mixture supplied to the combustion chambers either by making the mixture lean (air dilution) or by recirculating exhaust gases (EGR dilution). The dilution slows down the burn rate and reduces the gas temperature at the end of combustion and this reduces $NO_x$ formation. Also, the dilution reduces the output power and the engine throttling must be reduced to maintain the same power, which results in reduced pumping losses and improved fuel economy at a given power output.

There is a limit to which the mixture can be diluted with air and/or EGR gases because beyond this limit hydrocarbon emissions become excessive and ultimately the engine becomes unstable and prone to misfire. Engines therefore require careful calibration of the dilution to reduce emissions and improve fuel economy without sacrificing combustion stability.

It is common practice to use both lean burn and EGR dilution in combination and this results in high complexity in the engine calibration because of the number of variables, all of which are interrelated.

In many prior art systems, calibration is achieved by first setting a desired AFR (air to fuel ratio) and subsequently adding EGR dilution to the point where instability commences. This however assumes that the degree of EGR dilution can be controlled rapidly and accurately, which even with the use of closed loop EGR metering systems is not necessarily the case.

The reason why closed loop EGR control is ineffective is that the pressure difference between the intake manifold and the exhaust system varies significantly and rapidly during normal engine operation. At light load, the intake manifold vacuum is high and only a small proportion of EGR dilution is permissible and therefore significant flow restriction is required in the EGR metering system. On the other hand, at higher loads, the manifold vacuum drops while the demand for EGR dilution increases. The net result is that an EGR metering system that is capable of maintaining good accuracy at light load is incapable of meeting the EGR demand at higher loads because of excessive restriction in the EGR metering system.

The control steps in a closed loop control system relying on sensors and intervening actuators also result in slow response so that when the main air flow changes rapidly during transients, the EGR dilution cannot follow at the same rate with the result that the dilution setting is disturbed during the transients.

All these problems make conventional EGR metering systems poor in accuracy and response, expensive and unreliable.

OBJECT OF THE INVENTION

The present invention seeks to provide an engine having a management system that controls the proportion of dilution gases added to the combustible charge of an internal combustion engine and mitigates at least some of the foregoing disadvantages of the prior art.

SUMMARY OF THE INVENTION

According to the present invention, there is provided a spark ignition internal combustion engine comprising:

an intake manifold, a main throttle for regulating the intake of ambient air into the intake manifold, an EGR pipe connected between a point in the intake manifold downstream of the main throttle and a point in the exhaust system located downstream of the main restriction to exhaust gas flow, such that the exhaust gas pressure at the latter point is substantially constant during engine operation, and an EGR throttle rigidly connected for movement with the main throttle, the EGR throttle having a similar geometry to the main throttle such that the flow cross sections of the main throttle and the EGR throttle are in a fixed predetermined ratio to one another for all positions of the main throttle.

The pressure upstream of the EGR throttle of the present invention is substantially equal to the pressure upstream of the main throttle and therefore the EGR dilution is always in a fixed proportion to the intake air flow determined by the relative dimensions of the main and EGR throttles. Therefore, throughout the operating range in which EGR gases are allowed to flow through the EGR throttle, the intake charge always contains a fixed fraction of EGR gases. Since this dilution is fixed, it does not need to be controlled by the engine management system which may assume that this proportion of EGR gases is present as a baseline level. At times when the required dilution exceeds this baseline, then the engine management system may control the air dilution and/or an additional flow of EGR gases from another source, but in this case the dynamic range of the additional quantities of dilution gases controlled by the engine management system is significantly reduced and does not give rise to the problems discussed above. The baseline should correspond to the highest value of EGR that does not cause combustion instability over the entire speed and load range within which EGR dilution is used by the engine. This baseline, as earlier stated, is set by the relative dimensions of the main throttle and the EGR throttle.

EGR throttle valves mechanically linked to the main throttle have been proposed previously in the early days of EGR but the coupling between the two was not rigid. The couplings contained cams and/or lost motion linkages, the aim of which was to vary the dilution ratio to match the EGR demand over the engine operating range. This however could not be done successfully because the effective span of opening of the main throttle to reach full (100%) load is variable with engine speed and is in all cases less than the full span required at maximum speed. This presents the problem that the main throttle position alone is not sufficient to define the percentage load condition of the engine and the EGR demand which is related to the percentage load cannot be met accurately at all engine speeds. It is for this reason that more recent systems have resorted to closed loop metering of the EGR instead of progressively linking the movement of the EGR throttle as a function of the movement of the main throttle.

By contrast, in the present invention, the rigid connection between the EGR and main throttles is not intended to meet the entire EGR demand but seeks only to supply a fixed baseline of EGR gases that can be topped up as necessary by the engine management system to achieve the overall desired dilution level. In this way, the invention merely eases the burden on the management system by reducing the dynamic range of dilution ratios with which it has to cope. Because the management system is effectively only called upon to top up small quantities, its response time is not so critical and its accuracy can be much improved.

Furthermore, if the management system is to vary the overall dilution by altering the AFR rather than the EGR dilution, it can do so by adjusting the fuel metering rather than the air metering to effect a lean AFR, thereby permitting even faster response and reducing system cost and complexity.

In its simplest and most preferred embodiment, the invention only comprises the EGR throttle rigidly connected for movement with the main throttle and a lean burn fuel metering system which sets a fuel quantity for each engine speed and load condition that achieves the desired overall EGR and air dilution ratio. Such a system achieves a significant saving by obviating the need for an EGR metering system and relies only on the fuel calibration to minimise emissions and optimise fuel economy.

In an alternative embodiment of the invention, however, an auxiliary supply of EGR gases that is closed loop controlled may be provided to top up the baseline EGR gases while a stoichiometric AFR is supplied to the engine by the fuel metering system.

The control of the lean AFR calibration or of the auxiliary EGR supply may be based on matching the AFR or additional EGR to a precalibrated value. If closed loop control is used in this case, an error signal is developed corresponding to the difference between the desired AFR or additional EGR, as the case may be. As an alternative to relying on previous calibration, the control may be based on minimising engine instability, the dilution being increased as much as possible without initiating engine instability.

BRIEF DESCRIPTION OF THE DRAWINGS

The invention will now be described further, by way of example, with reference to the accompanying drawings, in which.

DESCRIPTION OF THE PREFERRED EMBODIMENTS

Figure 1:
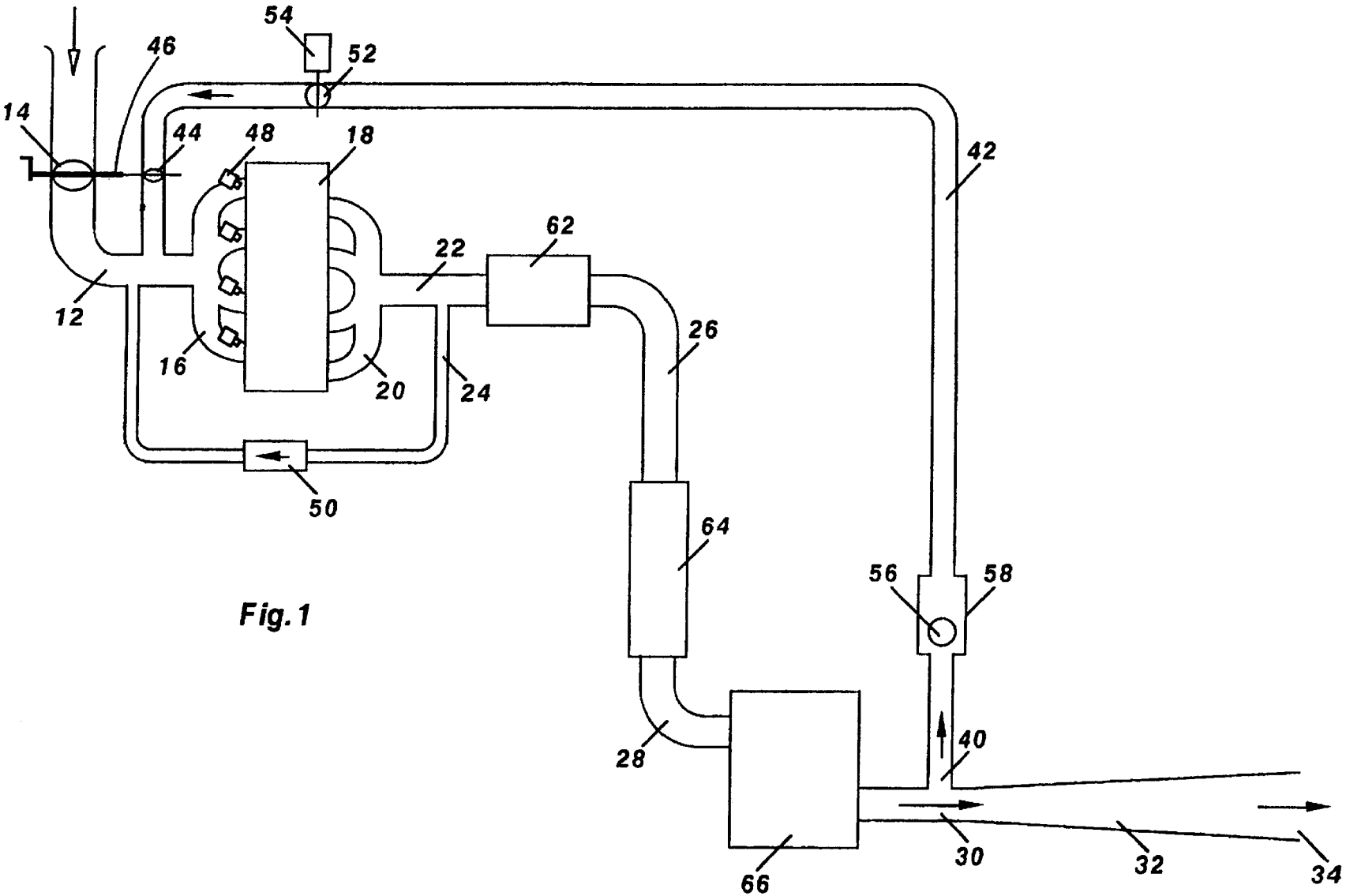
FIG. 1 a schematic diagram of an engine having a management system of the invention.

An engine 18 has an intake manifold 12 and an exhaust manifold 22. The intake manifold 12 has branches 16 leading to the individual cylinders with individual fuel injectors 48 in each branch and is connected to the ambient through a main throttle 14 linked in the usual manner to a demand pedal. The exhaust manifold 22 leads to an exhaust system that is comprised of a catalytic converter 62, a pipe 26, a first silencer 64, a further pipe 28, a second silencer 66 and a discharge pipe 30.

The engine is designed to operate with dilution of the intake charge with EGR gases and these are drawn from a point downstream of the silencer 66 through an EGR pipe 42 that is connected at its other end to a point in the intake manifold 12 downstream of the main throttle 14. The EGR pipe 42 contains an EGR throttle 44 that is geometrically similar to the main throttle 14 and is rigidly connected to the main throttle 14 by being mounted on a common spindle 46. This mechanical arrangement ensure that the open cross-sections of the main and EGR throttles 14 and 44 are always in a fixed ratio to one another. An on/off valve 52 controlled by a solenoid 54 is arranged in the EGR pipe 42 in series with the EGR throttle 44 to disable the exhaust gas recirculation under certain operating conditions notably idling and wide open throttle. The reason for this is that under idling conditions, the EGR dilution requirements are adequately met by internal recirculation while under wide open throttle conditions EGR must be discontinued to avoid impairing maximum power.

The section 32 of the exhaust pipe between the silencer 66 and the discharge 34 is shaped to achieve at the end 40 of the EGR pipe 42 an aerodynamic pressure that reduces progressively with increased exhaust gas flow velocity to a value slightly below the ambient atmospheric pressure. In case this pressure should ever be below the pressure in the intake manifold 12, a non-return valve 58 having a ball closure element 56 is also included in the EGR pipe 42.

An auxiliary EGR pipe 24 is also connected between the exhaust manifold 22 and the intake manifold 12 to supply through a electronically controlled regulating valve 50 an additional flow of EGR gases to supplement the flow through the EGR pipe 42.

Figure 2:
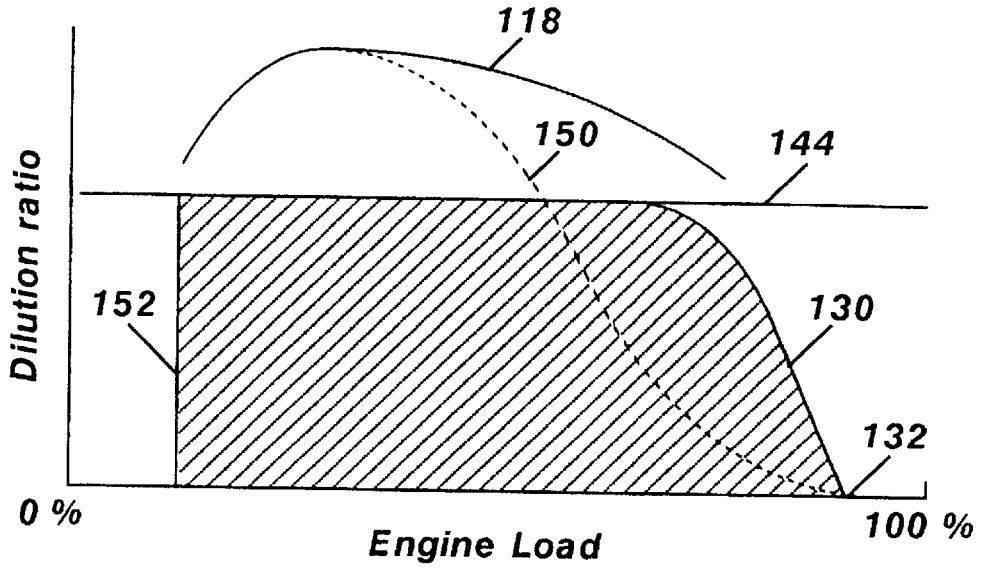
FIG. 2 is a graph showing the variation of EGR and air dilution ratio with increasing engine load.
Figure 3:
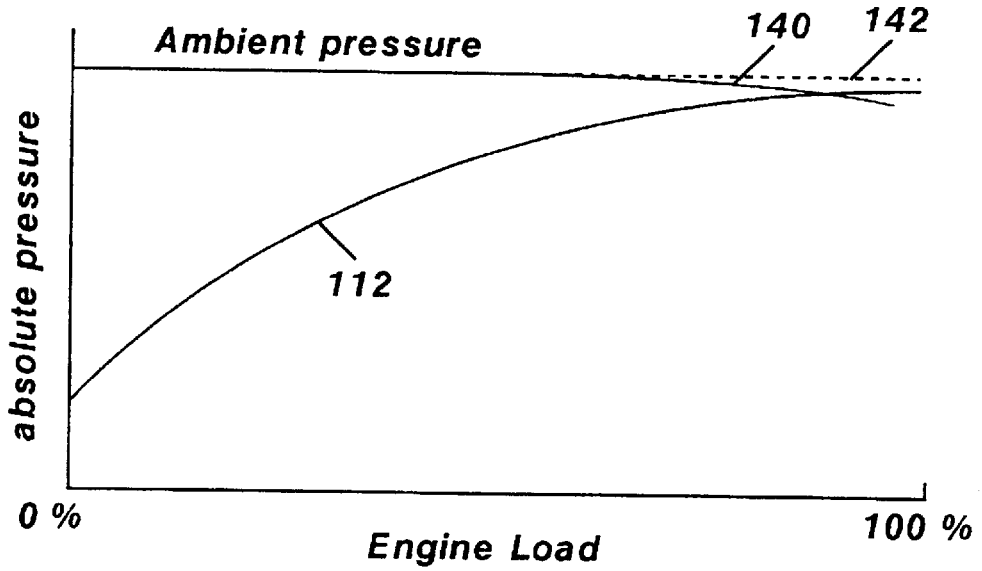
FIG. 3 is a graph showing the variation of the pressures at the opposite ends of the EGR pipe in FIG. 1 with increasing engine load.

The operation of the EGR management system will now be described by reference to FIGS. 2 and 3. While the engine is idling the valve 52 is closed and there is no external EGR. At the line 152 external EGR is commenced and for as long as the valve 52 remains open, a proportion of EGR corresponding to the shaded area in FIG. 2 is supplied to the engine through the EGR pipe 42. The line 144 is totally horizontal because the dilution ratio is constant over substantially the whole of the engine operating range because of the rigid connection between the main and EGR throttles 14 and 44. In this respect it will be noted that both throttles are acted upon on one side by pressure which is substantially the ambient atmospheric pressure and on the other side by the intake manifold pressure. Because the pressure differentials across both throttles are substantially equal, the gas flow rates through them is determined only by the open cross-sections of the respective throttles.

At the higher load of the power range in FIG. 2, the EGR is reduced gradually along the line 130 as the main throttle 14 is move towards full load. This is achieved by the design of the section 32 of the exhaust discharge pipe 30. As the main throttle 14 is move towards the 100% load position, the intake manifold pressure, which is represented by the line 112 in FIG. 3, rises towards atmospheric pressure but does not fully reach the ambient atmospheric pressure represented by the line 142. With the resultant increase in exhaust gas flow through the section 32, the pressure at the point 40, represented by the line 140 in FIG. 3, will progressively drop towards a pressure which is slightly below ambient atmospheric pressure, that is to say, to a pressure substantially equal to or less than the pressure in the intake manifold 12. This will automatically prevent the EGR flow across the EGR throttle 44. The non-return valve 58 ensures that even if the pressure at the point 40 should drop further below the pressure in the intake manifold 12, intake air will not be directed to the exhaust pipe while bypassing the engine 18. Instead of using a non-return valve, the on-off valve 52 may be shut at the point designated 132 in FIG. 2, to stop any reverse flow along the EGR pipe 42.

FIG. 2 also shows two further lines designated 118 and 150 respectively. The line 118 corresponds to the maximum permissible or desirable dilution. Hitherto control systems attempting to provide this level of dilution would in practice only reach the level represented by the line 150. The reason for this has been described above and is associated with the high level of restriction that is required to be able to deliver small quantities of EGR under high manifold vacuum conditions. Hence the curve 150 adheres closely to the curve 118 at low load and deviates from it more and more as the engine load increases.

The EGR supplied through the EGR throttle 44 and represented by the shaded area in FIG. 2 is the highest level that can be admitted to the engine over the entire engine operating range during which the valve 52 is open. Nevertheless it still fall short of the optimum dilution represented by the line 118. This EGR is therefore intended only as a baseline level of EGR dilution which may be topped up by an auxiliary supply of dilution gases to reach the optimum level 118. In the illustrated embodiment this top up EGR is achieved through the auxiliary EGR pipe 24 and the electronically controlled regulating valve 50. The dynamic range with which this auxiliary EGR supply is intended to cope is only small and corresponds to the small area above the line 144 and below the line 118. This reduced dynamic range make it easier to design a system that can more closely meet the engine demand at all times and if it should fail to do so during transients there is only the auxiliary EGR that is affected and the engine still continues to receive the baseline EGR through the EGR throttle 44.

The regulating valve 50 can be closed loop controlled to match the auxiliary EGR as closely as possible to a precalibrated value corresponding to the difference between the curves 118 and 144 in FIG. 2. Alternatively the regulating valve 50 may be closed loop control to maximise dilution while avoiding combustion instability.

Though the shortfall between the baseline 144 and the optimum 118 levels can be made up by auxiliary EGR dilution as described above, it may alternatively be made up by additional air dilution. This is to say that a lean AFR mixture may be supplied to the engine that in addition to the quantity of air stoichiometrically related to the fuel contains a quantity of air corresponding to the difference between the curves 118 and 144 in FIG. 2. The lean AFR can in this case be adjusted by the fuel metering system setting a reduced injection quantity from the fuel injector 48 allowing for a fast response. Once again the lean AFR may either be closed loop controlled to match a precalibrated valve or to maximise dilution while avoiding combustion instability. This last system is preferred because it obviates the need for an auxiliary EGR supply and relies on a minimum of hardware. This also makes for a reliable and robust system which has few operating variables and can be calibrated more simply and inexpensively.

The non-return valve 58 that uses a light ball 56 as a closure member has the advantage that in the event of the exhaust pipe being immersed in water, for example when the vehicle is driven through a ford, the ball 56 floats on the water and blocks the EGR pipe 42 to prevent water from being sucked into the combustion chambers and causing serious damage to the engine.

I claim:

1. A spark ignition internal combustion engine having an exhaust system connected thereto, the engine comprising:

an intake manifold;

a main throttle for regulating an intake of ambient air into the intake manifold, an EGR pipe connected between a point in the intake manifold downstream of the main throttle and a point in the exhaust system located downstream of a main restriction to exhaust gas flow, such that an exhaust gas pressure at the latter point is substantially constant during engine operation, and an EGR throttle rigidly connected for movement with the main throttle, the EGR throttle having a geometrical relationship to the main throttle such that a flow cross section of the main throttle and a flow cross section of the EGR throttle have a fixed predetermined ratio to one another for all positions of the main throttle.

2. An engine as claimed in claim 1, wherein the fuel metering system is operative to provide a lean AFR such that overall EGR and additional air dilution is set to a precalibrated value.

3. An engine as claimed in claim 1, further comprising an auxiliary source supplying EGR gases to the intake manifold to supplement a baseline EGR gas drawn in through the EGR pipe containing the EGR throttle.

4. An engine as claimed in claim 3, wherein the fuel metering system is operative to provide a lean AFR such that overall EGR and additional air dilution is set to a precalibrated value.

5. An engine as claimed in claim 1, further comprising an on/off valve arranged in series with the EGR throttle to prevent flow of EGR gases under predetermined engine operating conditions.

6. An engine as claimed in claim 5, wherein EGR gases are drawn from a discharge pipe in the exhaust system downstream of a last silencer in the exhaust system.

7. An engine as claimed in claim 5, further comprising an auxiliary source supplying EGR gases to the intake manifold to supplement a baseline EGR gases drawn in through the EGR pipe containing the EGR throttle.

8. An engine as claimed in claim 6, further comprising an auxiliary source supplying EGR gases to the intake manifold to supplement a baseline EGR gas drawn in through the EGR pipe containing the EGR throttle.

9. An engine as claimed in claim 6, wherein the discharge pipe is shaped to achieve an aerodynamic pressure that reduces progressively with increased exhaust gas flow velocity to a value slightly below the ambient atmospheric pressure at a connection between the discharge pipe and the EGR pipe.

10. An engine as claimed in claim 9, wherein a non-return valve is provided in the EGR pipe to prevent gas flow away from an end of the EGR pipe adjacent the intake manifold.

11. An engine as claimed in claim 1, wherein EGR gases are drawn from a discharge pipe in the exhaust system downstream of a last silencer in the exhaust system.

12. An engine as claimed in claim 11, wherein the discharge pipe is shaped to achieve an aerodynamic pressure that reduces progressively with increased exhaust gas flow velocity to a value slightly below the ambient atmospheric pressure at a connection between the discharge pipe and the EGR pipe.

13. An engine as claimed in claim 12, wherein a non-return valve is provided in the EGR pipe to prevent gas flow away from an end of the EGR pipe adjacent the intake manifold.

14. An engine as claimed in claim 13, further comprising an auxiliary source supplying EGR gases to the intake manifold to supplement a baseline EGR gas drawn in through the EGR pipe containing the EGR throttle.

15. An engine as claimed in claim 14, further comprising an auxiliary source supplying EGR gases to the intake manifold to supplement a baseline EGR gas drawn in through the EGR pipe containing the EGR throttle.

16. An engine as claimed in claim 14, wherein the auxiliary source is closed loop controlled to achieve a predetermined total EGR dilution in combination with the baseline EGR gases.

17. An engine as claimed in claim 14, wherein the auxiliary source is closed loop controlled to maximize EGR dilution while maintaining combustion stability.

18. An engine as claimed in claim 15, wherein the auxiliary source is closed loop controlled to achieve a predetermined total EGR dilution in combination with the baseline EGR gases.

19. An engine as claimed in claim 15, wherein the auxiliary source is closed loop controlled to maximize EGR dilution while maintaining combustion stability.

20. An engine as claimed in claim 18, wherein the fuel metering system is operative to provide a lean AFR such that overall EGR and additional air dilution is set to a precalibrated value.

* * * * *